United States Patent [19]

Araki et al.

[11] Patent Number: 4,903,671

[45] Date of Patent: Feb. 27, 1990

[54] AIR/FUEL RATIO CONTROL SYSTEM FOR FUEL INJECTION INTERNAL COMBUSTION ENGINE WITH IMPROVED ACCELERATION CHARACTERISTICS AFTER DECELERATION

[75] Inventors: Akihiko Araki; Junichi Furuya, both of Gunma, Japan

[73] Assignee: Japan Electronic Control Systems Company, Limited, Isezaki, Japan

[21] Appl. No.: 197,847

[22] Filed: May 24, 1988

[30] Foreign Application Priority Data

May 28, 1987 [JP] Japan ..... 62-129891

[51] Int. Cl.[4] ..... F02D 41/10; F02D 41/14

[52] U.S. Cl. ..... 123/489; 123/492

[58] Field of Search ..... 123/440, 489, 492, 493

[56] References Cited

U.S. PATENT DOCUMENTS 4,416,237 11/1983 Aoki et al. ..... 123/492 X 4,655,179 4/1987 Kashiwagura ..... 123/492 X 4,719,888 1/1988 Kobayashi et al. ..... 123/492 X 4,723,524 2/1988 Atago et al. ..... 123/492

FOREIGN PATENT DOCUMENTS 58-214629 12/1983 Japan .

*Primary Examiner*—Tony M. Argenbright

*Attorney, Agent, or Firm*—Foley & Lardner, Schwartz, Jeffery, Schwaab, Mack, Blumenthal & Evans

[57] ABSTRACT

An air/fuel ratio control system is designed for detecting small deceleration and subsequently detecting small magnitude acceleration. When small magnitude acceleration is detected, a LAMBDA control correction value which is utilized for deriving fuel injection amount, is fixed at a predetermined value for a predetermined period. The air/fuel ratio utilized during the aforementioned period is set at a value greater than the instantaneous value at a timing at which a demand for small magnitude acceleration is detected.

14 Claims, 5 Drawing Sheets

AIR/FUEL RATIO CONTROL SYSTEM FOR FUEL INJECTION INTERNAL COMBUSTION ENGINE WITH IMPROVED ACCELERATION CHARACTERISTICS AFTER DECELERATION

BACKGROUND OF THE INVENTION

1. Field of the Invention

The present invention relates generally to an air/fuel ratio control system for a fuel injection internal combustion engine. More specifically, the invention relates to an air/fuel ratio control system which improves engine acceleration characteristics.

2. Description of the Background Art

In general, amount of fuel to be delivered to engine cylinders of an internal combustion engine is controlled based on various engine driving parameters, such as an engine load, engine revolution speed and so forth. In case of a fuel injection type internal combustion engine, fuel delivery amount is derived in a form of a fuel injection pulse having a variable pulse width for driving a fuel injection valve for a controlled period. The fuel injection pulse width Ti is derived by well known equation:

$$Ti = Tp \times COEF \times K_{LAMBDA} + Ts$$

where

- Tp is a basic fuel injection pulse width to be derived on the basis of an engine speed N and an engine load Q ($Tp = K \times Q/N$: K is constant)
- COEF is a correction coefficient to be derived based on various fuel injection amount correction factors, such as acceleration enrichment demand, engine start-up enrichment demand, cold engine enrichment demand and so forth;
- $K_{LAMBDA}$ is an air/fuel ratio dependent correction coefficient for LAMBDA (λ) control; and
- Ts is a battery voltage compensative correction value As is well known, LAMBDA control is performed on the basis of oxygen concentration contained in an exhaust gas flowing through an exhaust passage. The correction coefficient $K_{LAMBDA}$ which will be hereafter referred to as "LAMBDA control correction coefficent" is derived so as to maintain the air/fuel ratio of an air/fuel mixture to be introduced into the engine cylinder at stoichiometric value. The LAMBDA control correction coefficient $K_{LAMBDA}$ generally comprises a proportional (P) component and an integral (I) component. At the initial stage of LAMBDA control, P component is adjusted based on the oxygen concentration indicative $O_2$ sensor signal value from an oxygen ($O_2$) sensor disposed in the exhaust passage. During subsequent LAMBDA control, I component is adjusted for gradually adjusting the LAMBDA control correction coefficient.

In practice, LAMBDA control is performed in CLOSED LOOP or FEEDBACK control in a predetermined stable engine driving condition, in which a predetermined FEEDBACK condition is satisfied. In the practical control, LAMBDA control is performed in LOW load and LOW engine speed range. In the engine driving range, in which the FEEDBACK condition is not satisfied, OPEN LOOP control is performed. During OPEN LOOP control, the LAMBDA control correction coefficient $K_{LAMBDA}$ is held at a fixed value. Such process in air/fuel ratio control has been disclosed in the Japanese Patent First (unexamined) Publication (Tokkai) Showa 58-214629.

LAMBDA control may be continued even in engine deceleration state if the engine deceleration magnitude is small enough. For example, a throttle valve angular variation in 15 miliseconds is smaller than 1.5°, air/fuel ratio control mode is held at LAMBDA control mode. Such engine driving condition where the engine deceleration magnitude is small enough to maintain LAMBDA control, will be hereafter referred to as "slow deceleration state". On the other hand, LAMBDA control may also be continued even in engine acceleration state when the engine speed accelerated to the engine speed range, e.g. 2400 r.p.m. to 2800 r.p.m., and approximately 60° of the throttle angular position. Such engine driving state where the engine is accelerated to a speed within an engine speed range where FEEDBACK condition is still maintained, will be hereafter referred to as "small magnitude acceleration". When such LAMBDA control is applied for a single point injection type internal combustion engine, which has a single fuel injection valve to be driven once in each engine revolution cycle, air/fuel ratio tends to become lean to degrade acceleration characteristics when acceleration demand to accelerate the engine to the engine speed range where LAMBDA control is to be continued, after small magnitude of deceleration.

Namely, during small magnitude of engine deceleration, intake vacuum in an induction passage is increased to remove fuel adhering on the inner periphery of the induction passage to dry the inner periphery up and to increase fuel amount to be contained in the air/fuel mixture to be introduced into the engine cylinder. Therefore, the air/fuel ratio becomes richer than stoichiometric value. Because LAMBDA control is maintained during small magnitude of engine deceleration, rich mixture ratio causes reduction of the fuel injection amount to be injected. If acceleration demand occurs for accelerating the engine in a magnitude that maintains the engine driving condition satisfying the FEEDBACK condition, LAMBDA control is maintained to start increasing of the fuel injection amount from the value reduced during deceleration.

Furthermore, since the inner periphery of the induction passage tends to be dried up during deceleration, part of the fuel injected in response to the acceleration enrichment demand can be consumed for making the inner periphery wet. This makes the air/fuel ratio leaner to further degrade acceleration characteristics.

SUMMARY OF THE INVENTION

Therefore, it is an object of the invention to provide an air/fuel ratio control system which can provide better acceleration characteristics even in an engine accelerating condition, in which LAMBDA control is to be maintained.

In order to accomplish aforementioned and other objects, an air/fuel ratio control system, according to the present invention, is designed for detecting small deceleration and subsequently detecting small magnitude acceleration. When small magnitude acceleration is detected, a LAMBDA control correction value which is utilized for deriving fuel injection amount, is temporarily set at a predetermined value for performing feedback control based thereon, for a given period. The air/fuel ratio to be utilizing the aforementioned period is set at a value greater than the instantaneous value at a timing, at which a demand for small magnitude acceleration is detected.

According to one aspect of the invention, an air/fuel ratio control system for a fuel injection internal combustion engine comprises a fuel injection valve disposed within an induction passage for injecting a controlled amount of fuel at a predetermined timing in synchronism with engine revolution, a first sensor means for monitoring air/fuel ratio indicative parameter for producing an air/fuel indicative first sensor signal, a second sensor means for monitoring engine driving parameter representative of engine driving condition for producing an engine driving condition indicative second sensor signal, the engine driving parameter including a factor representative of magnitude of deceleration and acceleration, and a controller means, operable in feedback mode when the engine driving condition satisfies predetermined feedback condition and an open loop mode otherwise, for deriving a fuel injection amount for driving the fuel injection valve on the basis of the second sensor signal, the controller operating in feedback mode for deriving a air/fuel ratio dependent correction value for correcting the fuel injection amount based on the first sensor signal value, the controller means detecting deceleration of engine in a magnitude smaller than a given deceleration criterion and subsequent acceleration in a magnitude smaller than a given acceleration criterion for setting the air/fuel ratio dependent correction value at a predetermined value.

According to another aspect of the invention, an air/fuel ratio control system for an internal combustion engine for controlling fuel injection amount in order to maintain an air/fuel ratio at a stoichiometric value, comprises a fuel injection valve disposed within an air induction passage for a controlled amount of fuel at a controlled timing in synchronism with the engine revolution, an engine speed sensor for monitoring a speed of engine revolution to produce an engine speed indicative first sensor signal, an engine load sensor for monitoring load condition on the engine to produce an engine load indicative second sensor signal, a throttle angle sensor associated with a throttle valve disposed in the air induction passage for monitoring angular position of the throttle valve for producing a throttle angle indicative third sensor signal, an air/fuel ratio sensor for monitoring an air/fuel ratio indicative engine parameter for producing an air/fuel ratio indicative fourth sensor signal, a controller means, being selectively operable in a feedback mode for feedback controlling fuel injection amount for adjusting air/fuel ratio at the stoichiometric value when the engine driving condition is held within a predetermined feedback range and in a open loop mode being performed in an engine driving condition is out of the feedback range, in which open loop mode, air/fuel ratio dependent fuel injection amount control is disabled, for deriving a basic fuel injection amount on the basis of the first and second sensor signal values and an air/fuel ratio dependent correction value on the basis of the fourth sensor signal for correcting the basic fuel injection amount during the feedback mode operation, the controller means setting the air/fuel ratio dependent correction value at a fixed value during the open loop operation, and producing a control signal for driving the fuel injection valve to control amount of fuel to be injected to the derived amount, the controller means detecting an engine deceleration state maintaining the engine driving condition within the feedback range and subsequent engine acceleration toward an engine speed within the feedback range for temporarily setting the air/fuel ratio dependent correction value at a predetermined value and performing feedback mode air/fuel ratio control for a given period of time during engine acceleration state.

In the preferred construction, the controller means receives the throttle position indicative signal to detect deceleration magnitude based on variation thereof. Practically, the controller means derives a difference between a first throttle angle indicative signal value which is initially sampled and a second throttle angle indicative signal value which is sampled at the end of a given period of time after sampling the first throttle angle indicative signal value, and checks the difference against a predetermined value range for detecting small magnitude deceleration. On the other hand, the controller means receives the throttle position indicative signal to detect deceleration magnitude based on the throttle valve angular position represented by the throttle position indicative signal. The controller means compares the throttle angle indicative signal value with a given threshold value representative of an engine speed criterion between high engine speed and low engine speed to detect small magnitude acceleration when the throttle angle indicative signal value is smaller than the given threshold.

Practically, the controller means set the air/fuel ratio dependent correction value to 1 in response to acceleration demand occurring after deceleration maintaining the engine driving condition within the feedback range, which air/fuel ratio dependent correction value represents stoichiometric value of air/fuel ratio.

BRIEF DESCRIPTION OF THE DRAWINGS

The present invention will be understood more fully from the detailed description given herebelow and from the accompanying drawings of the preferred embodiment of the invention, which, however, should not be taken to limit the invention to the specific embodiment but are for explanation and understanding only.

In the drawings.

DESCRIPTION OF THE PREFERRED EMBODIMENT

Figure 1:
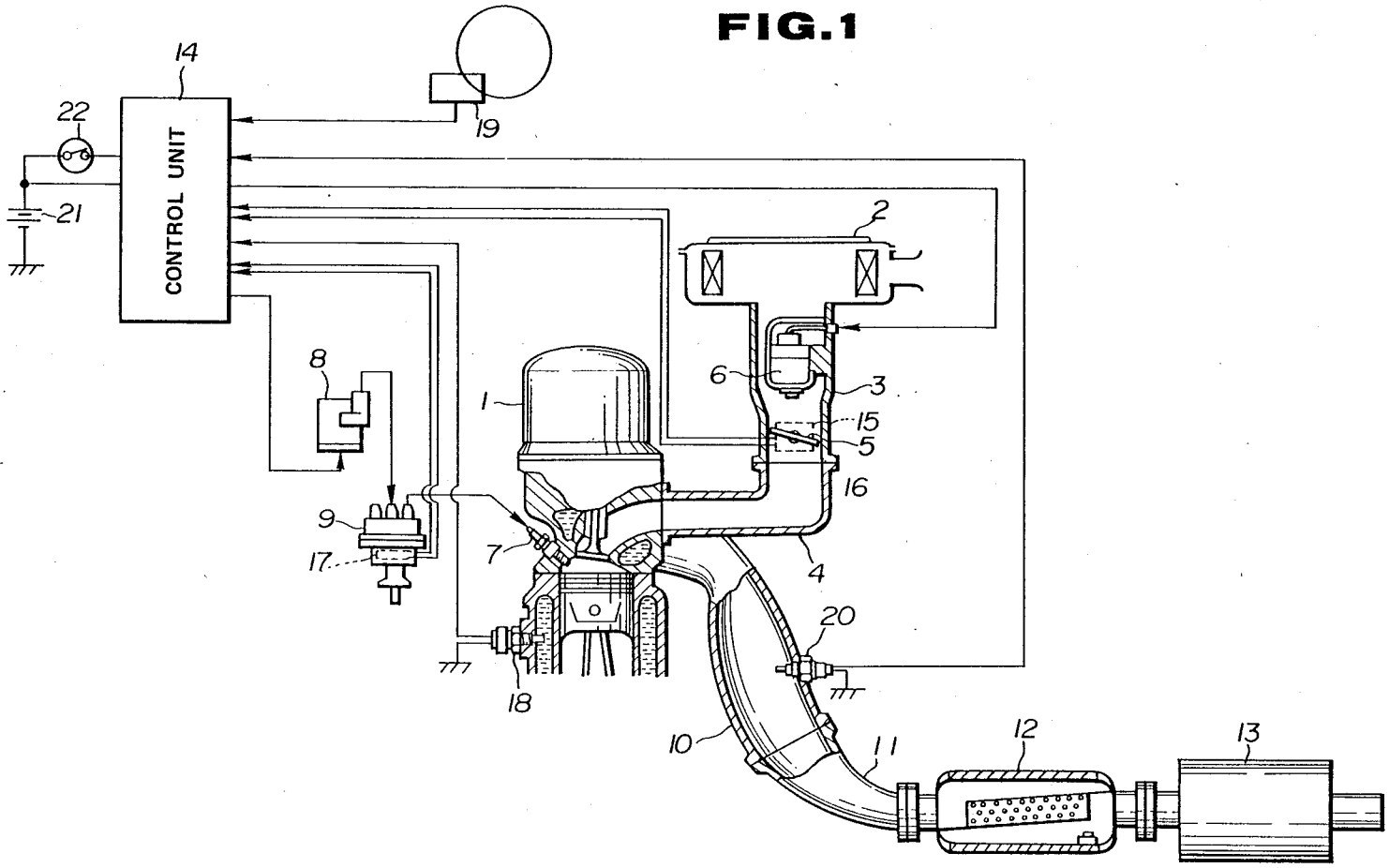
FIG. 1 is a schematic and diagramatic illustration showing the preferred embodiment of an air/fuel ratio control system according to the invention.

Referring now to the drawings, particularly to FIG. 1, the preferred embodiment of an air/fuel ratio control system, according to the invention, is applied for a single-point injection type fuel injection internal combustion engine which is generally represented by the reference numeral "10". The engine 10 has an air induction system including an air cleaner 12, an air flow meter 14, a throttle body 16 and an intake manifold 18. A throttle valve 20 is disposed within the throttle body 16 for adjusting induction rate of an air/fuel mixture.

In the shown embodiment, a fuel injection valve 22 is disposed within the throttle body 16 and upstream of the throttle valve 20. Therefore, the air/fuel mixture is formed at the position in the induction system upstream of the throttle valve. The air/fuel mixture flows through the throttle body 16 and introduced into an engine combustion chamber via the intake manifold 18 and an intake port which is open and closed by means of an intake valve.

The air/fuel mixture introduced into the engine combustion chamber is combustioned by spark ignition taken place by means of an ignition plug 24 which receives an ignition power from an ignition coil unit 26 via a distributor 28.

The engine 10 also has an exhaust system including an exhaust manifold 30, an exhaust duct 32, a catalytic converter unit 34 and a muffler 36.

In order to monitor the angular position of the throttle valve 20, a throttle angle sensor 38 is associated with the throttle valve 20 to produce a throttle angle indicative signal $\theta_{th}$ having a value indicative of the monitored throttle angle. In practice, the throttle angle sensor 38 comprises a potentiometer producing analog form throttle angle indicative signal having a voltage variable depending upon the throttle valve angular position. Though there is not clearly shown in the drawings, an engine idling condition detector switch may be additionally associated with the throttle valve for detecting fully closed or approximately fully closed position of the throttle valve.

A crank angle sensor 40 is coupled with the distributor 28 for monitoring a crank shaft angular position. For this, the crank angle sensor 40 has a rotary disc which is so designed as to rotate synchroneously with rotation of a rotor of the distributor. The crank angle sensor 40 produces a crank reference signal $0_{ref}$ at each of predetermined angular position and a crank position signal $\theta_{pos}$ at every time of predetermined angle of angular displacement of the crank shaft. In practice, the crank reference signal is generated every time the crank shaft is rotated at an angular position corresponding to 70° or 66° before top-dead-center (BTDC) in compression stroke of the engine cylinder. Therefore, in case of the 6-cylinder engine, the crank reference signal $0_{ref}$ is produced at every 120° of the crank shaft angular displacement. On the other hand, the crank position $\theta_{pos}$ is generated every given angular displacement, i.e. 1° or 2°, of the crank shaft.

An engine coolant temperature sensor 42 is disposed within an engine cooling chamber to monitor a temperature of an engine coolant filled in the cooling chamber. The engine coolant temperature sensor 42 is designed for monitoring the temperature of the engine coolant to produce an engine coolant temperature indicative signal Tw. In practice, the engine coolant temperature sensor 42 produces an analog form signal having a voltage variable depending upon the engine coolant temperature condition. Furthermore, the shown embodiment of the air/fuel ratio control system includes an oxygen sensor 44 disposed in the exhaust manifold 30. The oxygen sensor 44 monitors oxygen concentration contained in the exhaust gas to produce an oxygen concentration indicative signal $V_{ox}$ indicative of the monitored oxygen concentration. The oxygen concentration indicative signal $V_{ox}$ is a voltage signal variable of the voltage depending upon the oxygen concentration. In practice, the voltage of the oxygen concentration indicative signal varies across a zero voltage depending on rich and lean of the air/fuel ratio relative to a stoichiometric value.

In addition, the preferred embodiment of the air/fuel ratio control system, according to the invention, has a control unit 100 which comprises a microprocessor. The control unit 100 is connected to a vehicular battery 46 to receive power supply therefrom. An ignition switch 48 is interposed between the control unit 100 and the vehicular battery 46 to establish and block power supply.

Figure 2:
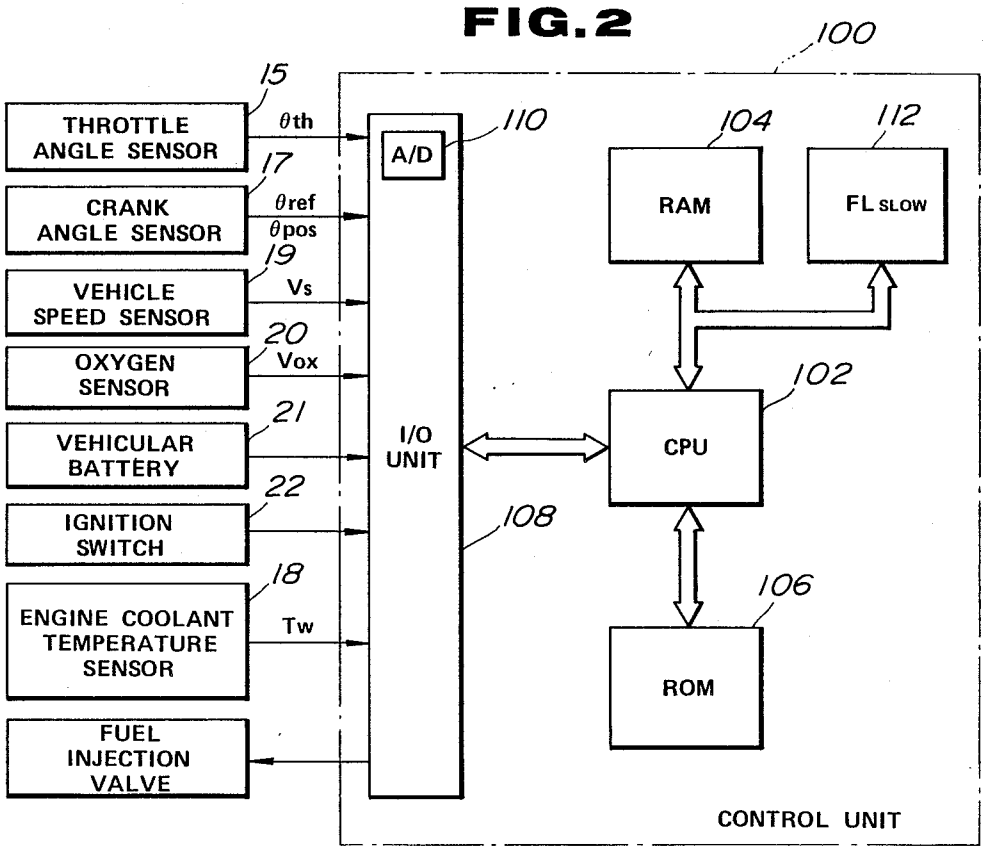
FIG. 2 is a block diagram of a control unit employed in the preferred embodiment of the air/fuel ratio control system of FIG. 1.

As shown in FIG. 2, the control unit 100 comprises CPU 102, RAM 104, ROM 106 and an input/output unit 108. The input/output unit 108 has an analog-to-digital converter 110 for converting analog inputs, such as the throttle angle indicative signal $\theta_{th}$, the engine coolant temperature indicative signal Tw and so forth, into digital signals.

The control unit 100 receives the throttle angle indicative signal $\theta_{th}$, the engine idling position indicative signal IDL, the crank reference signal $\theta_{ref}$, the crank position signal $\theta_{pos}$, the engine coolant temperature indicative signal Tw, the vehicle speed indicative signal Vs and oxygen concentration indicative signal $V_{ox}$. The control unit 100 derives an engine revolution speed data N on the basis of a period of the crank reference signal $\theta_{pos}$. Namely, the period of the crank reference signal $\theta_{ref}$ is inversely proportional to the engine speed, the engine speed data N can be derived from reciprocal of the period of the crank reference signal $\theta_{re}$. Also, the control unit 100 projects an intake air flow amount indicative data Q on the basis of the throttle angle position indicative signal value $\theta_{th}$.

Although the shown embodiment projects the intake air flow rate indicative data Q based on the throttle angle position indicative signal, it is, of course, possible to obtain the air flow rate indicative data Q directly by a known air flow meter. In the alternative, the intake air flow rate indicative data may also be obtained from intake vacuum pressure which may be monitored by a vacuum sensor to be disposed within the induction system.

Generally, the control unit 100 derives a basic fuel injection amount or a basic fuel injection pulse width Tp on the basis of the engine speed data N and the intake air flow rate indicative data Q which serves to represents an engine load. The basic fuel injection amount Tp is corrected by a correction factors derived on the basis of the engine coolant temperature Tw, the rich/lean mixture ratio indicative oxygen concentration indicative signal $V_{ox}$ of the oxygen sensor 44, a battery voltage and so forth, and an enrichment factor, such as engine start up enrichment factor, acceleration enrichment factor. The fuel injection amount modified with the correction factors and enrichment factors set forth above, is further corrected by a air/fuel ratio dependent correction coefficient derived on the basis of the oxygen concentration indicative signal $V_{ox}$ for adjusting the air/fuel ratio toward the stoichiometric value.

The practical operation to be performed in the control unit 100 of the preferred embodiment of the air/fuel ratio control system according to the invention, will be discussed herebelow with reference to FIGS. 3 and 4. In the following discussion, components of the control unit 100 which are not discussed in the preceding disclosure will be discussed with the functions thereof.

Figure 3:
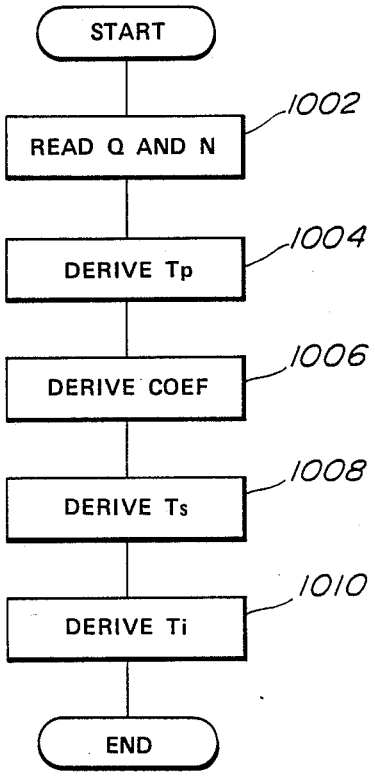
FIG. 3 is a flowchart of a fuel injection control program for deriving and setting a fuel injection pulse width.

FIG. 3 shows a flowchart of a fuel injection pulse setting routine for setting a fuel injection pulse width Ti in the input/output unit 108 of the control unit 100. The fuel injection pulse width Ti setting routine may be triggered at every given timing for updating fuel injection pulse width data Ti in the input/output unit 108.

At a step 1002, the intake air flow rate indicative signal Q and the engine speed data N are read out. Based on the engine speed data N and the intake air flow rate indicative data Q, the basic fuel injection amount Tp is derived at a step 1004. Practically, the basic fuel injection amount Tp can be calculated by the following equation:

$$Tp = K \times Q/N$$

where K is constant

At a step 1006, correction coefficients COEF is set. In practice, the correction coefficient COEF to be set here is constituted by an engine coolant temperature dependent component, an engine start-up acceleration enrichment component, an acceleration enrichment component and so forth. The Tw correction coefficient may be derived on the basis of the engine coolant temperature indicative signal Tw. The start-up enrichment correction coefficient may be derived in response to the ignition switch operated to a cranking position. In addition, the acceleration enrichment correction coefficient can be derived in response to an acceleration demand which may be detected from variation of the throttle angle indicative signal values. Manner of derivation of these correction coefficients are per se well known and unnecessary to be discussed in detail. For example, manner of derivation of the acceleration enrichment coefficient has been disclosed in the co-pending U.S. Pat. application Ser. No. 115,371, filed on Nov. 2, 1987, assigned to the common assignee to the present invention, for example. The disclosure of the above-identified co-pending U.S. Pat. application is herein incorporated by reference for the sake of disclosure.

Based on the basic fuel injection amount Tp derived at the step 1004, the correction coefficient COEF derived at the step 1006 and the battery voltage dependent correction value Ts set at the step 1008, a fuel injection amount Ti is calculated at a step 1010 according to the following equation:

$$Ti = Tp \times COEF + Ts$$

A fuel injection pulse width data corresponding to the fuel injection amount Ti derived at the step 1010, which will be hereafter referred to as "Ti data", is set in the input/out unit 108.

The correction coefficient COEF may further include a LAMBDA (λ) control component which is derived on the basis of the oxygen concentration indicative signal $V_{ox}$. The LAMBDA control is performed by correcting the fuel injection amount utilizing the LAMBDA control component for maintaining the air/fuel ratio of the air/fuel mixture at the stoichiometric value. Since the oxygen concentration indicative signal value of the oxygen sensor 44 tends to fluctuate at significant level while the engine is driven at high load and high speed condition and while the engine is in transition, LAMBDA control cannot be performed. In such unstable engine driving condition, OPEN LOOP control may be performed. Therefore, the control unit 100 is set a FEEDBACK condition to perform LAMBDA control when the engine driving condition as represented by preselected engine driving condition representative parameter, such as engine speed, throttle valve angular position variation rate, engine load and so forth, satisfies the FEEDBACK condition.

Figure 4:
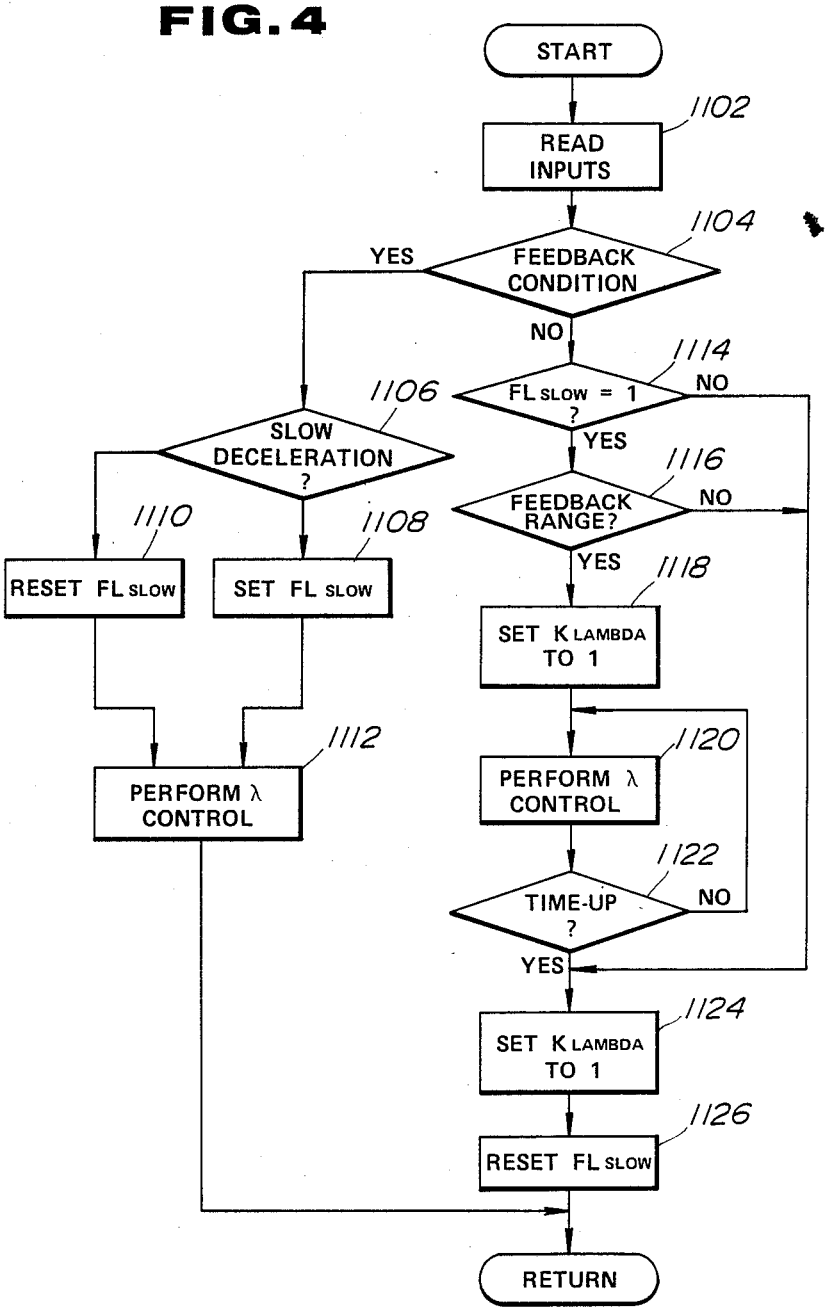
FIG. 4 is a flowchart of an air/fuel ratio control program for deriving a LAMBDA control correction coefficient.

FIG. 4 shows a practical process in deriving the LAMBDA control correction coefficient $K_{LAMBDA}$. At a step 1102, respective of relevant engine driving parameters, such as engine speed data N, throttle angle data $\theta_{th}$, the oxygen concentration indicative signal $V_{ox}$ and so forth are read out. At a step 1104, the engine driving condition is checked on the basis of the read engine driving parameters whether the FEEDBACK condition is satisfied or not.

When the engine driving condition as checked at the step 1104 satisfies the FEEDBACK condition, check is performed whether the engine is in slow deceleration state or not, at a step 1106.

In practice, the slow deceleration state of the engine is detected by comparing variation of throttle angle indicative signal value within a given period of time, e.g. 15 miliseconds. For this purpose, the throttle angle indicative signal values are sampled. A difference between first sampled throttle angle indicative signal value and last sampled throttle angle indicative signal value within the given period is compared with a slow deceleration threshold −1.5°. When the difference is within a range between 0° to −1.5°, judgement is made that the engine is in slow deceleration state, at the step 1106.

When small deceleration state of the engine is detected at the step 1106, a slow deceleration indicative flag $FL_{SLOW}$ is set in a $FL_{SLOW}$ flag register 112 of the control unit 100, at a step 1108. On the other hand, when the engine driving condition as checked at the step 1106, the slow deceleration indicative flag $FL_{SLOW}$ is reset at a step 1110. After one of the step 1108 and 1110, the LAMBDA control correction coefficient $K_{LAMBDA}$ is derived mainly based on the oxygen concentration indicative signal $V_{ox}$, at a step 1112. Then, at the step 1112, LAMBDA control is set as one of correction parameter for correcting the basic fuel injection amount Tp. Then process goes END.

On the other hand, when the FEEDBACK condition is not satisfied as checked at the step 1104, the slow deceleration indicative flag $FL_{SLOW}$ is checked at a step 1114. When the slow deceleration indicative flag $FL_{SLOW}$ is set as checked at the step 1114, check is made at a step 1116 whether the engine driving condition is small magnitude acceleration state or not.

In practice, small magnitude acceleration state is detected by monitoring magnitude of acceleration demand. Namely, the engine speed can be approximately represented by the throttle angular position, the throttle angle indicative signal value is compared with a predetermined small magnitude acceleration threshold which represents the engine speed of 2400 r.p.m. to 2800 r.p.m., for example. As set forth, since the 2400 r.p.m. to 2800 r.p.m. of engine speed is represented by a throttle angle approximately 60°. Therefore, the small magnitude acceleration threshold represents a predetermined throttle angular position approximately corresponding to the engine speed.

If the engine driving condition is small magnitude acceleration state as checked at the step 1116, the LAMBDA control correction coefficient $K_{LAMBDA}$ is set at a value 1, at a step 1118. Thereafter, LAMBDA control is triggered at at step 1120. LAMBDA control is maintained after triggered for a given period of time. During LAMBDA control, elapsed time after triggering, is checked at a step 1122. As long as the elapsed time is shorter than the given period of time, LAMBDA control is continued. On the other hand, when the elapsed time becomes longer than or equal to the given period, the LAMBDA control correction coefficient $K_{LAMBDA}$ is set to 1 and fixed at the set value, at a step 1124.

When the slow deceleration indicative flag $FL_{SLOW}$ is not set as checked at the step 1114, or when the throttle angular position indicative signal value $\theta_{th}$ is greater than the smaller magnitude acceleration threshold, process goes to the step 1124 jumping the steps 1118, 1120 and 1122.

After setting the LAMBDA control correction coefficient $K_{LAMBDA}$ to 1, the slow deceleration indicative flag $FL_{SLOW}$ is reset at a step 1126. After the step 1126, process goes END.

Figure 5A:
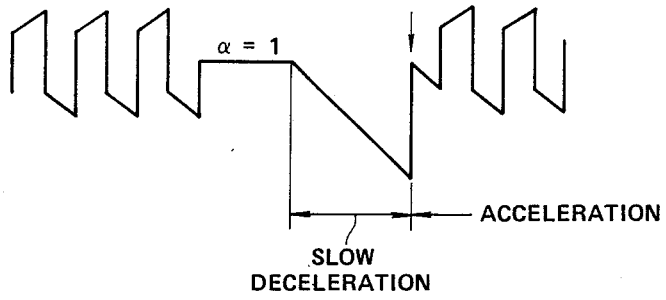
FIGS. 5(A) and 5(B) are chart showing variation of the LAMBDA control correction coefficient as controlled by the air/fuel ratio control systems of the prior art and of the invention.
Figure 5B:
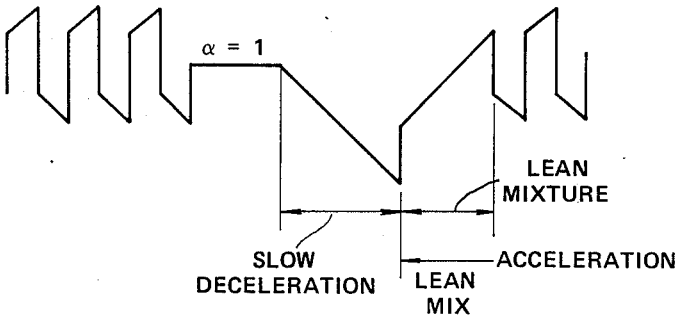

Quicker response to the acceleration demand can be seen in FIGS. 5(A) and 5(B). As seen in both of inventive (FIG. 5(A)) and conventional (FIG. 5(B)) air/ fuel ratio, the LAMBDA control correction coefficient $K_{LAMBDA}$ is gradually decreased by decreasing integral component cyclically. In the conventional system, modification of the LAMBDA control correction coefficient $K_{LAMBDA}$ starts from the decreased value as seen from FIG. 5(B). On the other hand, since the preferred embodiment of the air/fuel ratio control system sets the LAMBDA control correction coefficient $K_{LAMBDA}$ at 1 in response to the acceleration demand to start modification from 1. This clearly improves engine acceleration characteristics in response to acceleration demand occuring after slow deceleration, Therefore, the invention fulfills all of the objects and advantages sought therefor.

While the present invention has been disclosed in terms of the preferred embodiment in order to facilitate better understanding of the invention, it should be appreciated that the invention can be embodied in various ways without departing from the principle of the invention. Therefore, the invention should be understood to include all possible embodiments and modifications to the shown embodiments which can be embodied without departing from the principle of the invention set out in the appended claims.

What is claimed is:

1. An air/fuel ratio control system for a fuel injection internal combustion engine, said air/fuel ratio control system comprising:

a fuel injection valve disposed within an induction passage for injecting a controlled amount of fuel at a predetermined timing in synchronism with engine revolution;

a first sensor means for monitoring an air/fuel ratio indicative parameter for producing an air/fuel indicative first sensor signal;

a second sensor means for monitoring an engine driving parameter representative of an engine driving condition for producing an engine driving condition indicative second sensor signal, said engine driving parameter including a deceleration and acceleration magnitude representing factor representative of a magnitude of deceleration and acceleration;

a controller means, operable in a feedback mode when said engine driving condition satisfies a predetermined feedback condition and in an open loop mode otherwise, for deriving a fuel injection amount for driving said fuel injection valve on the basis of said second sensor signal, said controller means operating in said feedback mode for deriving an air/fuel ratio dependent correction value for correcting said fuel injection amount based on said first sensor signal, said controller means detecting deceleration of said internal combustion engine at a magnitude smaller than a given deceleration criterion and subsequent acceleration at a magnitude smaller than a given acceleration criterion for setting said air/fuel ratio dependent correction value at a predetermined value.

2. An air/fuel ratio control system as set forth in claim 1, wherein said controller means triggers feedback mode operation subsequent to setting of said air/fuel ratio dependent correction value at said given value for maintaining feedback mode operation for a given period of time.

3. An air/fuel ratio control system as set forth in claim 1, wherein said controller means sets said air/fuel ratio dependent correction value to 1 which represents a stoichiometric value of air/fuel ratio.

4. An air/fuel ratio control system as set forth in claim 1, wherein said second sensor means includes a throttle angle sensor monitoring a throttle valve angular position to produce a throttle angle position indicative signal serving as said deceleration and acceleration magnitude representing factor.

5. An air/fuel ratio control system as set forth in claim 4, wherein said controller means receives said throttle position indicative signal to detect deceleration magnitude based on variation thereof.

6. An air/fuel ratio control system as set forth in claim 5, wherein said controller means derives a difference between a first throttle angle indicative signal value which is initially sampled and a second throttle angle indicative signal value which is sampled at an end of a given period of time after sampling said first throttle angle indicative signal value, and checks said difference against a predetermined value range for detecting small magnitude deceleration.

7. An air/fuel ratio control system as set forth in claim 4, wherein said control means receives said throttle position indicative signal to detect deceleration magnitude based on said throttle valve angular position represented by said throttle position indicative signal.

8. An air/fuel ratio control system as set forth in claim 7, wherein said controller means compares said throttle angle indicative signal value with a given threshold value representative of an engine speed criterion between high engine speed and low engine speed to detect small magnitude acceleration when said throttle angle indicative signal value is smaller than said given threshold.

9. An air/fuel ratio control system for an internal combustion engine for controlling fuel injection amount in order to maintain an air/fuel ratio at a stoichiometric value, said air/fuel ratio control system comprising:

a fuel injection valve disposed within an air induction passage for injecting a controlled amount of fuel at a controlled timing in synchronism with engine revolution;

an engine speed sensor for monitoring a speed of engine revolution to produce an engine speed indicative first sensor signal;

an engine load sensor for monitoring a load condition on said internal combustion engine to produce an engine load indicative second sensor signal;

a throttle angle sensor associated with a throttle valve disposed in said air induction passage for monitoring angular position of said throttle valve for producing a throttle angle indicative third sensor signal;

an air/fuel ratio sensor for monitoring an air/fuel ratio indicative engine parameter for producing an air/fuel ratio indicative fourth sensor signal;

a controller means, selectively operable in a feedback mode for feedback controlling a fuel injection amount for adjusting said air/fuel ratio at said stoichiometric value when an engine driving condition is held within a predetermined feedback range and in an open loop mode performed when said engine driving condition is out of said feedback range, in said open loop mode, air/fuel ratio dependent fuel injection amount control is disabled, for deriving a basic fuel injection amount on the basis of said first and second sensor signals and an air/fuel ration dependent correction value on the basis of said fourth sensor signal for correcting said basic fuel injectdion amount during said feedback mode, said controller means setting said air/fuel ratio dependent correction value at a fixed value during open loop operation, and producing a control signal for driving said fuel injection valve to control an amount of fuel to be injected to a derived amount, said controller means detecting an engine deceleration state maintaining said engine driving condition within said feedback range and subsequent engine acceleration toward an engine speed within said feedback range for temporarily setting said air/fuel ratio dependent correction value at a predetermined value and performing feedback mode air/fuel ratio control for a given period of time during an engine acceleration state.

10. An air/fuel ratio control system as set forth in claim 9, wherein said controller means receives said throttle position indicative signal to detect deceleration magnitude based on variation thereof and thereby detect engine decelerating condition held within said feedback condition.

11. An air/fuel ratio control system as set forth in claim 10, wherein said controller means derives a difference between a first throttle angle indicative signal value which is initially sampled and a second throttle angle indicative signal value which is sampled at an end of a given period of time after sampling said first throttle angle indicative signal value, and checks said difference against a predetermined value range for detecting small magnitude deceleration.

12. An air/fuel ratio control system as set forth in claim 10, wherein said controller means receives said throttle position indicative signal to detect acceleration magnitude based on a throttle valve angular position represented by said throttle position indicative signal and thereby detects an engine speed to be accelerated being within said said feedback condition.

13. An air/fuel ratio control system as set forth in claim 12, wherein said controller means compares said throttle angle indicative signal value with a given threshold value representative of a feedback range indicative criterion.

14. An air/fuel ratio control system as set forth in claim 9, wherein said controller means sets said air/fuel ratio dependent correction value to 1 which represents a stoichiometric value of said air/fuel ratio.

* * * * *